US005806281A

United States Patent [19]

Krul et al.

[11] Patent Number: 5,806,281

[45] Date of Patent: Sep. 15, 1998

[54] TEAR TAPE ADAPTED FOR COMPLETE SEALING OF PACKAGE OVERWRAP

[75] Inventors: Robert J. Krul; Kenneth A. Thomas, both of Winnipeg, Canada

[73] Assignee: KT Industries Inc., Fort Wayne, Ind.

[21] Appl. No.: 655,775

[22] Filed: May 31, 1996

[51] Int. Cl.[6] ..... B65B 61/18

[52] U.S. Cl. ..... 53/412; 53/463; 53/477

[58] Field of Search ..... 428/352, 354, 428/906; 53/412, 419, 463, 477, 133.5, 133.6, 133.7, 137.2

[56] References Cited

U.S. PATENT DOCUMENTS

| | | | |
|---|---|---|---|
| 3,881,041 | 4/1975 | Glienke | 428/906 X |
| 4,887,408 | 12/1989 | Mattei et al. | 53/412 |
| 5,203,935 | 4/1993 | May et al. | 53/133.5 X |
| 5,273,805 | 12/1993 | Calhoun et al. | 428/906 X |
| 5,496,636 | 3/1996 | Gu et al. | 428/906 X |

FOREIGN PATENT DOCUMENTS 2099940 1/1994 Canada .

*Primary Examiner*—Linda Johnson
*Attorney, Agent, or Firm*—Adrian D. Battison; Murray E. Thrift

[57] ABSTRACT

A packaged product includes an overwrap material wrapped around the product and overlapped to form a seam bonded to prevent ingress of moisture and a tear tape to tear the overwrap material. The tear tape has a first pressure sensitive layer for bonding to the overwrap and a second layer opposite the first having characteristics such that it acts as a release coat to inhibit bonding of the tear tape to itself and such that it acts to bond the substrate to the overwrap material. The second layer converts by heat from the release coat condition to the bonding condition by being absorbed into the first sub-layer or by including a hard rough surface arranged to inhibit bonding to the first layer which is melted.

7 Claims, 2 Drawing Sheets

FIG. 1
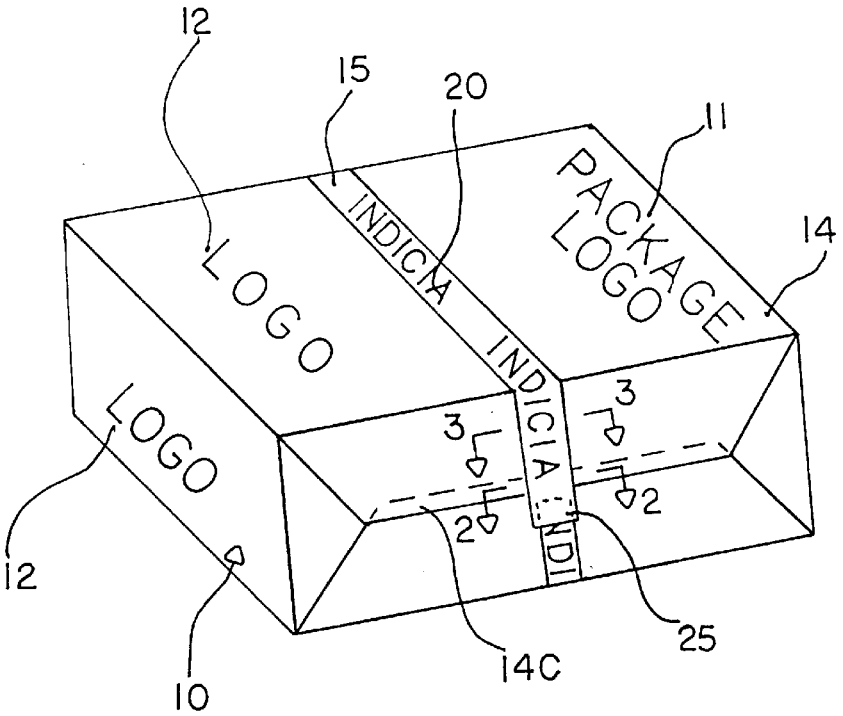
FIG. 2
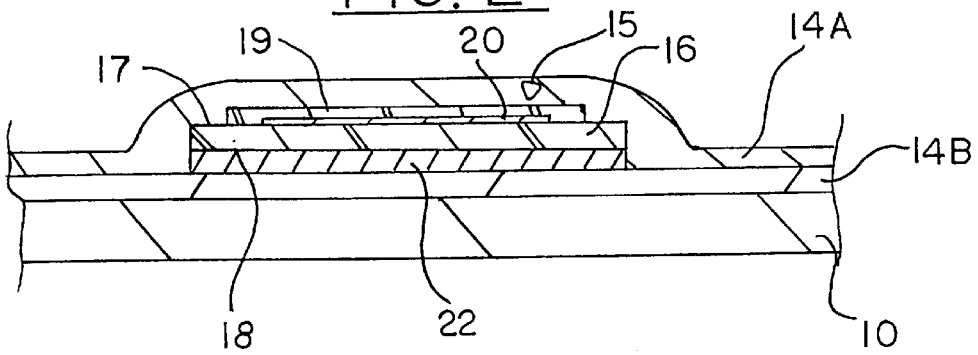
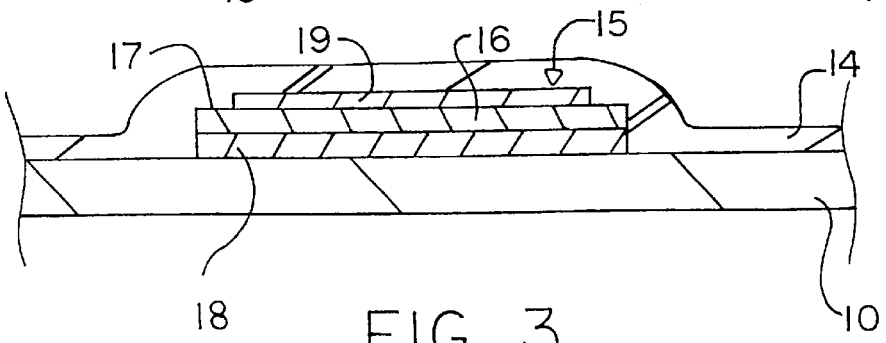
FIG. 3

TEAR TAPE ADAPTED FOR COMPLETE SEALING OF PACKAGE OVERWRAP

This invention relates to a tear tape which is adapted to allow complete sealing of a package overwrap.

BACKGROUND OF THE INVENTION

In Canadian application 2,099,940, laid open on 7th Jan. 1994, is disclosed a package construction, which is particularly but not exclusively designed for cigarette packages, in which a plastics overwrap is wrapped around the cardboard package and heat sealed at overlapping seams around the package to provide effectively a complete moisture and air impermeable seal around the package.

It is highly desirable in such packages to provide a tear tape which allows the end user to remove the packaging film or overwrap to allow access to the package and the contents. The tear tape in the packaging process is attached to the inside surface of the overlap material and passes through the seam at a "notch". A suitable adhesive is provided on one surface of the tear tape for attachment to the overwrap material. Such adhesive can be a hot melt adhesive applied at the packaging line or it can be a pressure sensitive adhesive which is applied at a separate location and supplied with the packaged tear tape material. In both cases it has been difficult to effect bonding of the opposite side of the tear tape to the overwrap. This therefore leaves a narrow space in the sealing of the package which has a width equal to the width of the tear tape. While this space is relatively small in comparison with the remainder of the area of the package, it can be sufficient in regard to some products to allow sufficient penetration of air and escape of moisture to cause degradation of the product.

The above patent application therefore attempts to provide a technique which allows full sealing of the package even at the "notch".

However the industry is presently moving toward the use of tear tape which carries a pressure sensitive adhesive as it is applied from the package. Such adhesive tear tape requires the application of a release coat to the rear or opposite surface of the tear tape to prevent bonding of the pressure sensitive adhesive to the rear surface while the tape is in the packaged structure. Such a release coating is not bondable to the overwrap material and necessarily therefore leaves an opening at the notch through which the air and moisture can penetrate.

SUMMARY OF THE INVENTION

It is one object of the present invention, therefore, to provide an improved tear tape which allows the use of a pressure sensitive adhesive while also providing a fully sealed package when the tear tape is incorporated into the package.

According to one aspect of the invention there is provided a tear tape for attachment to a packaging overwrap material comprising a tape substrate having a width and strength to act to tear the overwrap material when pulled, the substrate having a first surface and a second opposed surface, a first layer on the first surface which is a pressure sensitive adhesive layer for bonding to the overwrap, and a second layer on the second surface, the second layer having characteristics thereof arranged such that it acts as a release coat to inhibit bonding of the first layer to the substrate when rolled into a package and such that it acts to bond the substrate to the overwrap material.

The tear tape thus provides both characteristics of the release coating for use in the package and also the bonding characteristics which allow the tear tape to be bonded to the overwrap to provide a complete seal.

Preferably the second layer is convertible for example by the application of heat from the first condition providing a release to the second condition providing a bondable layer.

The invention further provides a wrapped or packaged using the tear tape and also a method of wrapping a product using the tear tape.

One embodiment of the invention will now be described in conjunction with the accompanying drawings in which:

BRIEF DESCRIPTION OF THE DRAWINGS

FIG. 1 is an isometric view of a package according to the present invention.

FIG. 2 is a cross sectional view on an enlarged scale showing schematically the layers of the packaging material including the package body, the tear tape and the overwrap material, the cross section being taken along the lines 2—2 of FIG. 1.

FIG. 3 is a similar cross sectional view showing the package body, the tear tape and the overwrap material taken along the lines 3—3 of FIG. 1.

In the drawings like characters of reference indicate corresponding parts in the different figures.

DETAILED DESCRIPTION

Figure 4:
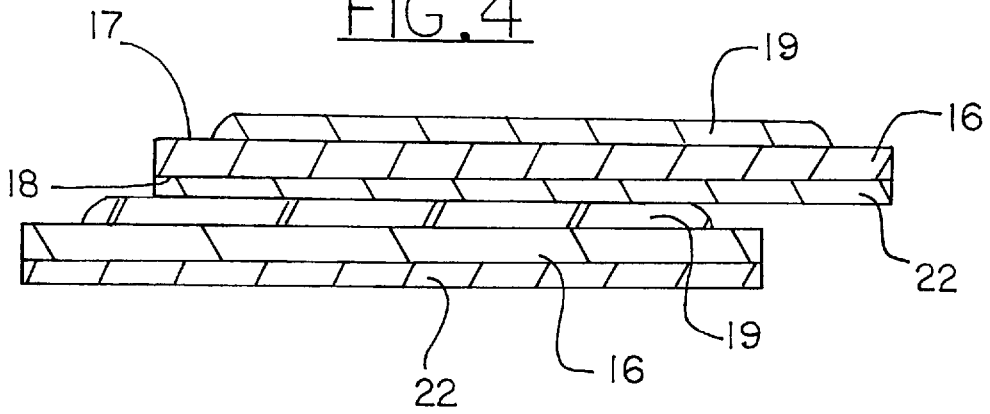
FIG. 4 is a cross sectional view of the tape of the present invention showing two overlapping tape portions as formed into a rolled package of the tape.

The type of package to which the present invention relates is shown in FIGS. 1, 2 and 3 which are taken from the above prior Canadian Application No. 2,099,940 laid open on 7th Jan. 1994. This is illustrated in one example as a cigarette package including an outer package body formed of a paper material and indicated at 10. On the paper material is printed the necessary information including logos 11 and 12. The construction of the folded paper package is conventional and therefore will not be described in detail herein.

Around the paper package body is wrapped a layer of an overwrap material 14 which comprises a transparent, tearable plastics film which is generally but not exclusively of polypropylene which has the desirable characteristics of moisture impermeability, tearability, clear transparency and sufficient strength to resist abrasion or impact damage. The overwrap material is wrapped around the package and folded at fold lines so as to shape the material to encompass the whole of the package with seams 14C one of which is visible along one side edge of the package. The seams are provided by an overlapping of two layers 14A and 14B of the overwrap material which are heat sealed together by the application of heat and pressure to provide a complete circumferential seal around the seams so that the whole of the package is fully enveloped by the moisture impermeable material.

A tear tape 15 is wrapped around the package between the package and the overwrap to allow tearing of the overwrap at the line defined by the tear tape for unwrapping and removal of the overwrap.

The tear tape 15 includes a tape body 16 formed of a suitable plastics material to provide the required longitudinal strength to effect the tearing action. Preferably the tear tape body 16 is formed from polyester which is biaxially or monoaxially oriented which has been found to provide the required degree of strength and other characteristics such as the ability to print indicia on the layer and the ability of the material to be wound into a cylindrical package of the material. In one example the thickness of the polyester material may lie in the range 0.00048 to 0.002 inches and the width of the tape body will be of the order of 1.6 to 10 mm and more preferably 2 to 5 mm.

The tape body 16 includes an outer or first surface 17 and an inner or second surface 18. As shown in FIG. 3 at the majority of the periphery of the package, the inside surface 18 lies adjacent or in contact with the package material 10. The outer surface 17 carries an adhesive layer 19 which acts to bond the outer surface of the tear tape body to the inner surface of the overwrap material. The adhesive layer 19 is of a pressure sensitive type. The adhesive layer can be narrower than the tape to define two edges which are free from the adhesive as shown or can be of full width of the tape.

On the outer surface 17 of the tape body is applied a layer of printed indicia 20 which is applied to the surface 17 prior to the application of the adhesive 19. The adhesive is sufficiently transparent that the indicia are visible through the adhesive layer and through the overwrap material as shown in FIG. 1.

The tape carrying the adhesive layer 19 is of the type supplied in a rolled package a small portion of which is shown in cross section in FIG. 4. In the rolled package, one layer of tape lies on top of another layer of tape. In some package construction the tape layers are directly one on top of the next in part of the package structure. In other constructions of package, one layer is slightly offset from the next. In all cases the layer of adhesive 19 necessarily comes into contact with the second surface of the tape structure.

The second surface 18 must therefore carry a second layer 22 which acts in the structure of the package as a release coat to prevent bonding of the pressure sensitive adhesive layer 19 to the second surface 18 of the tape structure. Thus the tape can be unrolled from the rolled package structure for application to the package.

The second layer 22 is designed in the present invention as a special layer acting in a first condition as a release coat for preventing bonding in the package structure and in a second condition as a bonding agent for bonding to the overwrap material. Thus in the package structure as shown in FIGS. 1, 2 and 3, the underside of the layer 22 is bonded to the upper surface of the overwrap layer 14B so as to form a complete seal between the underside of the tear tape and the overwrap material at the junction to prevent the penetration of moisture and air into the interior of the package underneath the overwrap.

The layer 22 is arranged to be bondable generally by the application of heat to the overwrap material but does not bond to the paper or board package itself so as to prevent the tear tape from being bonded to the package when torn away with the overwrap. While this may be a characteristic of the layer, the heat to effect the bonding is applied only at the overlap of the materials and hence this reduces the possibility that the tape bonds to the paper package.

Figure 5:
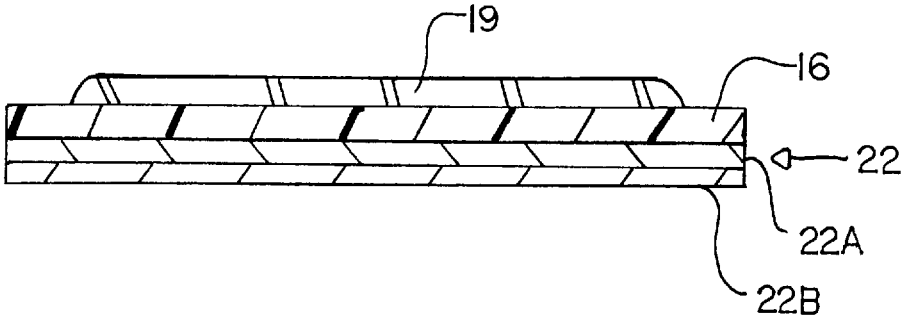
FIG. 5 is a cross sectional view of the tape of the present invention showing more detail of the second layer which acts as a release coat and an adhesive for bonding to the overwrap material.
Figure 6:
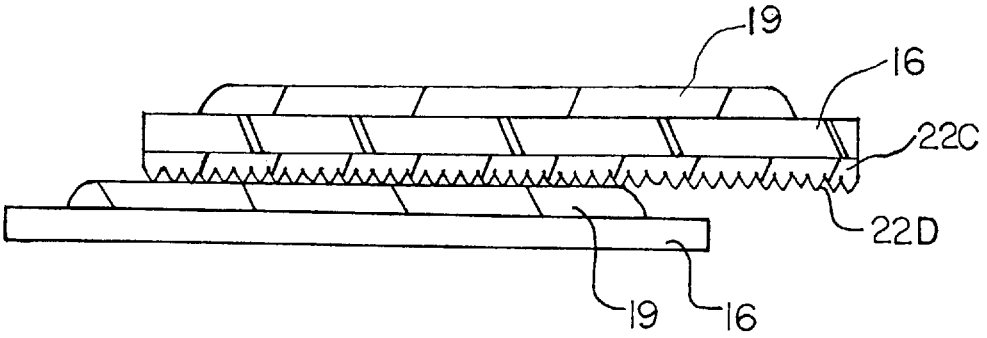
FIG. 6 is a cross sectional view through a second embodiment of the tape according to the present invention showing further details of the second layer and showing the second layer acting as a release coat.

Two techniques for converting the layer 22 from the first condition to the second condition are shown in FIGS. 5 and 6. In FIG. 5 the layer 22 is formed of a first layer 22A of a hot melt adhesive and a second layer 22B of a silicone release coat. The layer 22A is in a cold condition sufficiently hard and impermeable so that the silicone layer in a very thin coat remains sitting on the exposed surface of the layer 22A to provide a release action relative to the pressure sensitive layer 19.

On application of heat to the layer 22, the layer 22 can change its condition so that it becomes heat bondable to the overwrap material. This is achieved by application of heat to the layer which causes softening and some melting of the layer 22A thus causing the thin release coating to be absorbed into the layer 22A. Selected hot melted adhesives can be provided which have this condition of absorbing the silicone. The amount of silicone is sufficiently small so that when absorbed it does not interfere with the bonding effect. The chemistry of the hot melt layer is arranged so that it acts to absorb the layer 22B away from the surface so that the surface presented by the layer 22 is then wholly of the hot melt material 22A with the silicone absorbed therein.

While the release coating is shown as a separate layer, this may be provided by an additive into the layer 22A which blooms to the surface of the layer on cooling of the layer so that the heat bonding material and the blooming agent are applied as a single coat.

The application of heat is effected by the same heating bar which acts to heat seal the overwrap material along the seam 14C.

In FIG. 6 is shown an alternative arrangement in which the layer 22C is provided with a release characteristics by providing the layer with very hard surface 22D which is roughened to provide a series of ribs or projections which thus significantly limit the amount of contact between the pressure sensitive adhesive 19 and the layer 22C in the package structure.

When heated in the packaging process at the time of sealing the overlap of the seams of the overwrap, the layer 22C is heated sufficiently to melt the layer to reduce the hardness of the surface and the roughness of the surface thus allowing it to become bondable to the overwrap.

In the packaging process, therefore, the tape is supplied in the rolled form with the layer 22 acting as a release coating. The tape is then pulled from the package in cold condition and applied to the overwrap upstream of the packaging process. The adhesive layer 19 thus bonds the tear tape to the overwrap in the required location so that the overwrap can be brought up to the package and wrapped around the package using conventional wrapping machines. When wrapped, heat is applied by a pair of platens which apply heat to the seams to effect bonding of the seams of the overwrap and at the same time applying heat to the layer 22. The heat applied to the layer 22 effects a change of condition so that it no longer acts as a release coat but instead acts as a bonding agent to effect heat sealing or heat bonding of the underside of the tear tape to the overwrap material. At the areas where the heat is not applied, the layer 22 remains in its initial condition so that there is no possibility of bonding to the packaging material.

We claim:

1. A method of packaging a product comprising:

providing the product;

providing an overwrap material;

providing a tear tape in a rolled package of the tear tape;

the tear tape comprising a tape substrate having a width and strength to act to tear the overwrap material when pulled, the substrate having a first surface and a second opposed surface;

providing a first layer on the first surface which is a pressure sensitive adhesive layer for bonding to the overwrap material;

providing a second layer on the second surface, the second layer providing an outer exposed surface;

causing the outer surface of the second layer, when the tear tape is rolled into the package, to form a release surface to inhibit bonding of the first layer to the second surface of the substrate;

unwinding the tear tape from the package;

attaching the tear tape by the first pressure sensitive adhesive layer to the overwrap material to be wrapped therewith around the product;

wrapping the overwrap material around the product to fully enclose the product and overlapping the overwrap material to form at least one overlapped seam;

bonding the seam to prevent escape of moisture from the product and ingress of air to the product;

causing the outer surface of the second layer to change in surface characteristics such that it no longer acts as a release surface and instead it acts as an adhesive surface for bonding to the overwrap material when in contact therewith;

and bonding the outer surface of the second layer to the overwrap material at the seam to prevent escape of moisture from the product and ingress of air to the product at the seam between the tear tape and the overwrap material.

2. A method of packaging a product comprising:

providing the product;

providing an overwrap material;

providing a tear tape in a rolled package of the tear tape;

the tear tape comprising a tape substrate having a width and strength to act to tear the overwrap material when pulled, the substrate having a first surface and a second opposed surface;

providing a first layer on the first surface which is a pressure sensitive adhesive layer for bonding to the overwrap material;

providing a second layer on the second surface, the second layer providing an outer exposed surface;

causing the outer surface of the second layer, when the tear tape is rolled into the package, to form a release surface to inhibit bonding of the first layer to the second surface of the substrate;

unwinding the tear tape from the package;

attaching the tear tape by the first pressure sensitive adhesive layer to the overwrap material to be wrapped therewith around the product;

wrapping the overwrap material around the product to fully enclose the product and overlapping the overwrap material to form at least one overlapped seam;

bonding the seam to prevent escape of moisture from the product and ingress of air to the product;

applying heat to the second layer and thereby causing the outer surface of the second layer to change in surface characteristics such that it no longer acts as a release surface and instead it acts as an adhesive surface for bonding to the overwrap material when in contact therewith;

and bonding the outer surface of the second layer to the overwrap material at the seam to prevent escape of moisture from the product and ingress of air to the product at the seam between the tear tape and the overwrap material.

3. The method according to claim 2 including:

providing in the second layer a first sub-layer attached to the substrate and a second sub-layer which covers the first sub-layer and defines the outer exposed surface;

causing the outer surface of the second sub layer to act as the release surface;

and causing the application of heat to the second layer to effect absorption of the second sub-layer into the first sub-layer so as to allow the first sub-layer to bond to the overwrap material.

4. The method according to claim 3 including providing the first sublayer as a hot melt adhesive.

5. The method according to claim 2 including providing on the second layer a hard rough surface arranged to inhibit bonding of the first layer to the second surface and causing the application of heat to effect melting and softening of the exposed outer surface of the second layer to allow the second layer to bond to the overwrap material.

6. The method according to claim 2 wherein the application of heat to the second layer also acts to effect heat bonding of the seam in the overwrap material.

7. The method according to claim 2 wherein the product includes a covering layer underneath the overwrap material and wherein the second layer is bonded to the overwrap material in a manner which avoids any bonding of the second layer to the covering layer.

* * * * *